US007685750B2

(12) United States Patent
Voitchovsky

(10) Patent No.: US 7,685,750 B2
(45) Date of Patent: Mar. 30, 2010

(54) COLLAPSIBLE IRONING BOARD

(75) Inventor: Serge Voitchovsky, Méziéres (CH)

(73) Assignee: Laurastar S.A., Châtel-St-Denis (CH)

( * ) Notice: Subject to any disclaimer, the term of this patent is extended or adjusted under 35 U.S.C. 154(b) by 147 days.

(21) Appl. No.: 11/883,878

(22) PCT Filed: Jan. 27, 2006

(86) PCT No.: PCT/IB2006/050310

§ 371 (c)(1),
(2), (4) Date: Sep. 5, 2007

(87) PCT Pub. No.: WO2006/087645

PCT Pub. Date: Aug. 24, 2006

(65) Prior Publication Data

US 2008/0209775 A1 Sep. 4, 2008

(30) Foreign Application Priority Data

Feb. 15, 2005 (CH) ..... 261/05

(51) Int. Cl.
*D06F 81/02* (2006.01)
*A47B 3/00* (2006.01)

(52) U.S. Cl. ..... 38/103; 108/122; 108/133

(58) Field of Classification Search ..... 38/103–140; 108/122, 123, 127–133; 248/164, 431, 432
See application file for complete search history.

(56) References Cited

U.S. PATENT DOCUMENTS 1,115,731 A * 11/1914 Owens ..... 108/35
1,217,772 A * 2/1917 Kade ..... 108/120
2,424,734 A * 7/1947 Booth ..... 108/118
2,645,045 A * 7/1953 Lewis ..... 38/107
2,647,333 A * 8/1953 Olshefski ..... 108/169
4,714,224 A * 12/1987 Calmes ..... 248/465
5,335,604 A * 8/1994 Jiang ..... 100/119

FOREIGN PATENT DOCUMENTS

| | | |
|---|---|---|
| EP | 0 708 194 A1 | 4/1996 |
| EP | 1 245 716 A2 | 10/2002 |
| EP | 1 245 716 A3 | 10/2002 |
| GB | 729630 | 5/1955 |
| GB | 804645 | 11/1958 |
| GB | 922439 | 4/1963 |

OTHER PUBLICATIONS

International Search Report mailed May 26, 2006 in PCT/IB2006/050310.
English translation of International Preliminary Report on Patentability—mailed in corresponding PCT Appln. No. PCT/IB2006/050310.

* cited by examiner

*Primary Examiner*—Ismael Izaguirre
(74) *Attorney, Agent, or Firm*—Nixon & Vanderhye P.C.

(57) ABSTRACT

A collapsible ironing board comprising a board arranged on two legs (1, 2) forming an X configuration, the center of the X constituting the central axis (C) about which the two legs (1, 2) can pivot; at least one (2) of the two legs being hinged and consisting of two continuous segments pivoting about a hinge axis (D), which ironing board is characterized in that it includes return means (R) located in the environment of the hinge axis (D), said return means (R) comprising a first end and a second end connected to the first segment and to the second segment, respectively, of the hinged leg (2).

16 Claims, 4 Drawing Sheets

COLLAPSIBLE IRONING BOARD

This application is the US national phase of international application PCT/IB2006/050310 filed 27 Jan. 2006 which designated the U.S. and claims benefit of CH 000261/05, dated 15 Feb. 2005, the entire content of which is hereby incorporated by reference.

FIELD OF THE INVENTION

The invention relates to ironing. It is more particularly concerned with collapsible ironing boards comprising two legs forming an X configuration, the center of the X constituting the central axis about which the two legs can pivot.

PRIOR ART

Several kinds of ironing board correspond to the definition given above. Ironing boards comprising a hinged leg consisting of two continuous segments pivoting about an axis are also known. This axis, termed the hinge axis in the present text, is usually located between the top end of the hinged leg and the central axis about which both legs can pivot. Ironing boards with a hinged leg as described earlier are disclosed in the following patent documents: EP 0 708 194 A1, GB 804 645 and GB 729 630.

The existence of a hinged leg offers certain advantages, notably the ease with which the board can be folded.

However, there are a number of drawbacks to the prior art ironing boards described above. In particular, the hinged leg may fold accidentally when the board is in the open position and is being moved. This danger is accentuated if the board includes items weighing it down, such as a steam generator mounted on one of the legs. In fact, the same problem can occur when trying to keep the board closed. In this case, the hinged leg may open accidentally.

There is therefore a need to improve ironing boards having a hinged leg, and especially to improve the stability of the open or closed position of boards and/or facilitate the opening or closing of boards having a hinged leg.

SUMMARY OF THE INVENTION

In the invention, the solution to the above problem is to provide return means in the environment of the hinge axis.

In one embodiment of the invention, the return means comprise a first end and a second end connected to the first segment and to the second segment, respectively, of the hinged leg.

In another embodiment of the invention, the return means comprise a spring.

The return means are preferably mounted inside the hinged leg.

The return means are advantageously so arranged as to exert a return force in a direction parallel to the direction of the hinged leg when in the open position. In this way the hinged leg benefits from an additional force to keep it open.

In another embodiment of the invention, the distance between the hinge axis and the first point of connection of the return means to the first segment of the hinged leg is different from the distance between the hinge axis and the second point of connection of the return means to the second segment of the hinged leg. Also, at least a part of the return means can move out of the hinged leg so that a return force can be applied to the hinged leg when the leg is folded. In this way the stability of the closed position of the ironing board is improved.

The return means advantageously consist of a spring and a rigid rod, one of the ends of which is connected to one of the ends of the spring. The other end of the rigid rod being connected to and able to pivot on one of the segments of the hinged leg.

DETAILED DESCRIPTION OF THE INVENTION

The invention is described below in more detail with the aid of an example illustrated in the following figures.

Figure 1A:
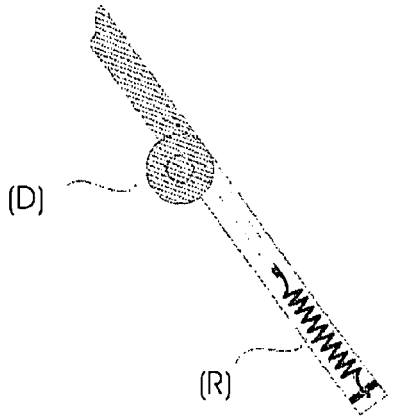
FIG. 1 shows a board according to the invention in the open position.
Figure 1B:
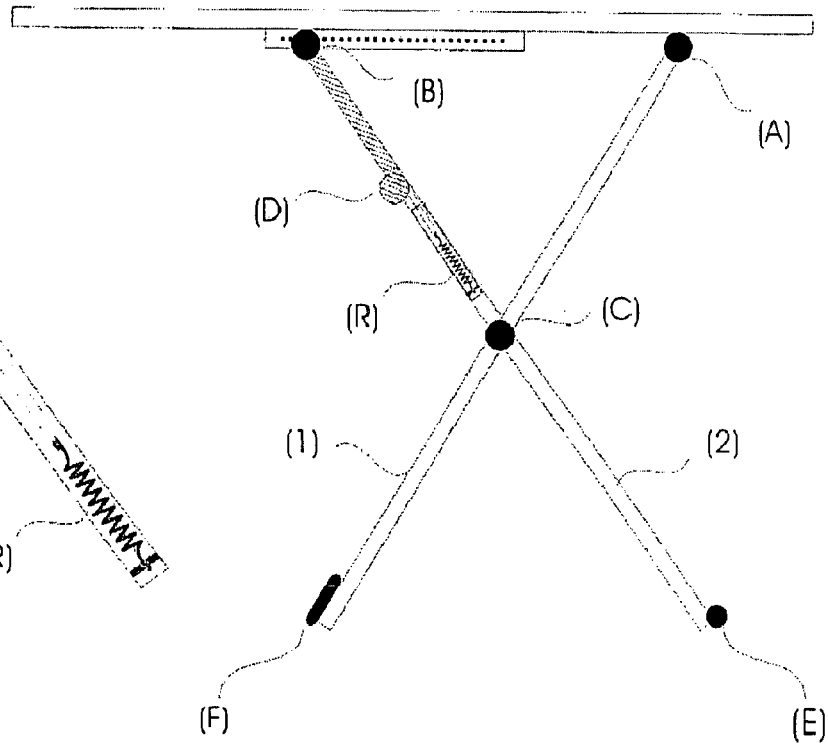
Figure 2A:
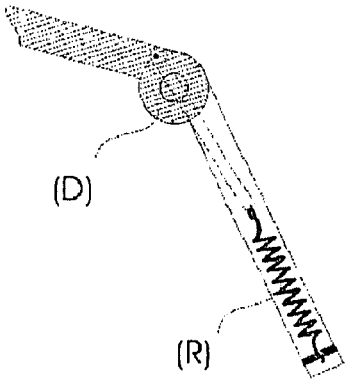
FIG. 2 shows the same board partially closed.
Figure 2B:
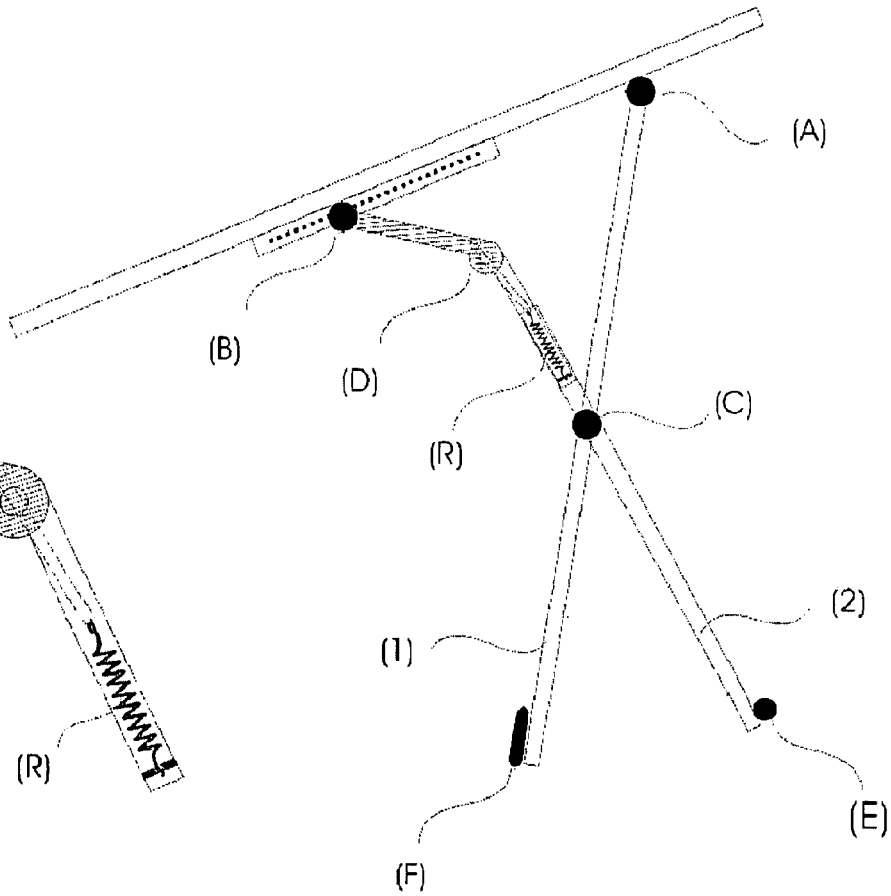
Figure 3A:
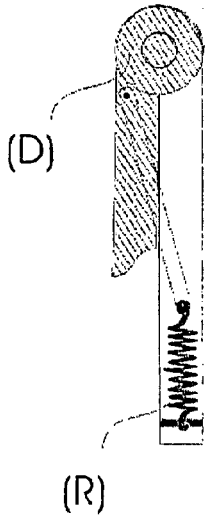
FIG. 3 shows the same board in the closed position.
Figure 3B:
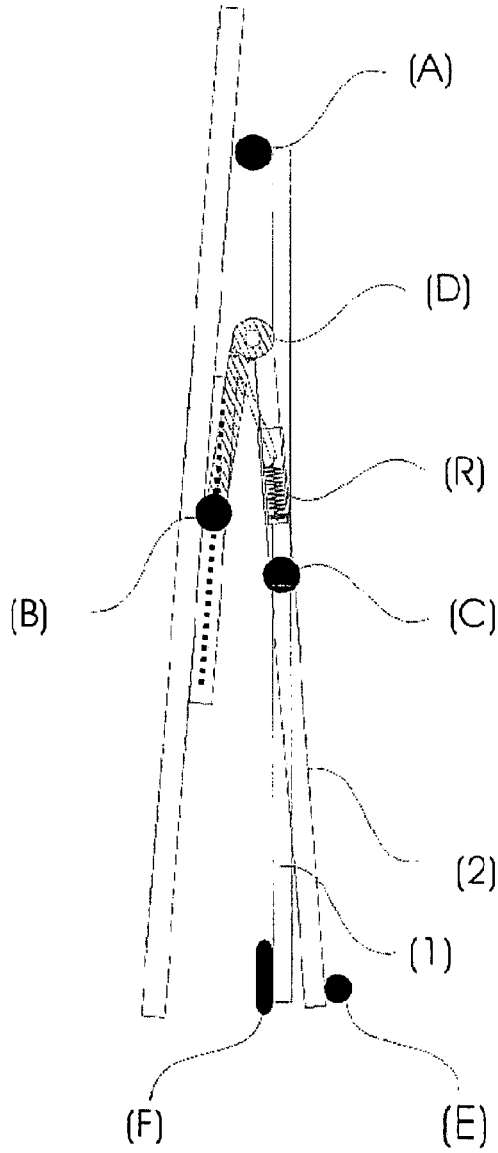

FIGS. 1-3 each show two views, namely a general view of the board (the right-hand side of the figure) and a view of the environment of the hinge pin D of the hinged leg 2 (the left-hand side of the figure).

The ironing board illustrated in FIGS. 1-4 comprises two legs 1, 2 forming an X. The tops of the legs 1, 2 are connected to the actual board, specifically at a fixed pivoting point A in the case of the non-hinged leg 1 and at a bridge B sliding in a track in the case of the hinged leg 2. Both legs 1, 2 pivot about a central axis C. At the bottom of the hinged leg 2 are wheels E whose axes of rotation are perpendicular to the general direction of the ironing board. At the bottom of the non-hinged leg 1 are wheels F whose axes of rotation are perpendicular to the axes of the wheels E at the bottom of the hinged leg 2.

The wheels F at the bottom of the non-hinged leg 1 are advantageously used for moving the board when the board is closed (see FIG. 4), while the wheels E at the bottom of the hinged leg 2 are preferably used for moving the board when the board is open.

The hinged leg 2 comprises return means consisting of a spring R and a rigid rod. The lower end of the spring R is connected to the lower segment of the hinged leg 2 and the upper end of the rigid rod is connected to and pivots on the upper segment of the hinged leg 2.

The spring R and the rod are assembled in such a way as to produce two actions: When the hinged leg is open, the spring R forces the hinged leg 2 to stay open (see FIG. 1) and when the hinged leg 2 is closed, i.e. folded, the spring R forces the hinged leg to stay closed (see FIG. 3).

Figure 4A:
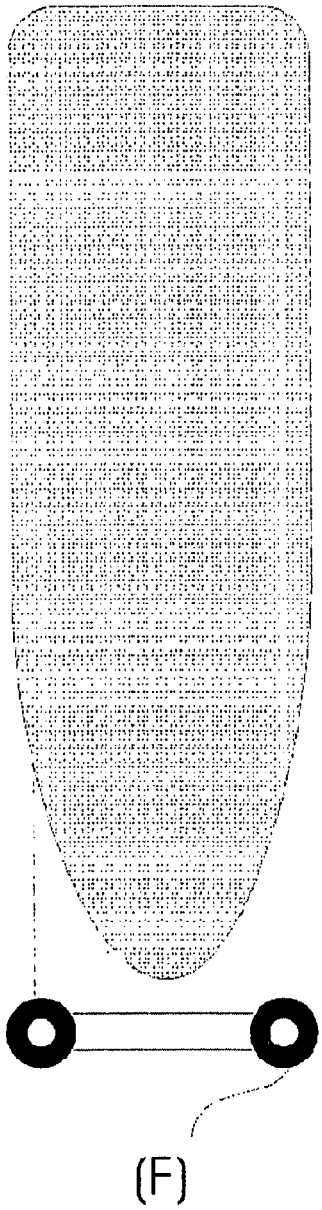
FIG. 4 shows other views of the same board in the closed position.
Figure 4B:
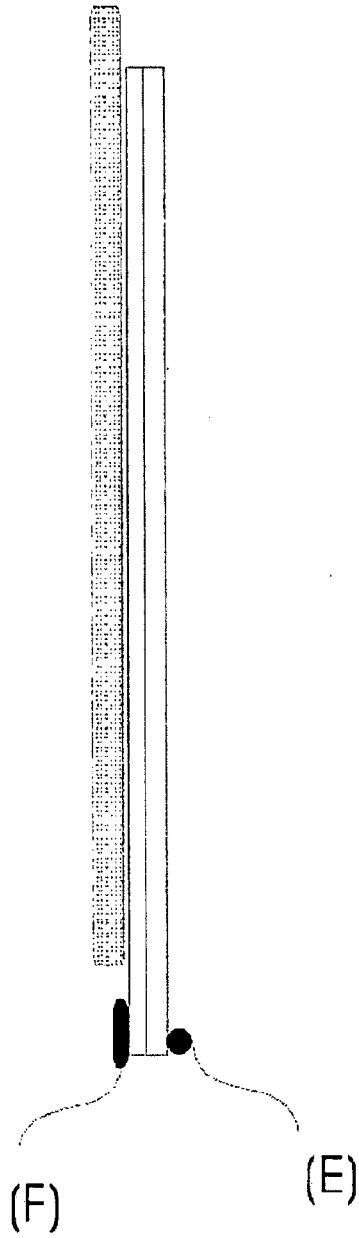

By virtue of the arrangement of the return means described above, when the board is open (FIG. 1), the hinged leg 2 is held more firmly in the open position. It becomes possible to move the ironing board by holding it at its point, when the board will roll on the wheels E located at the bottom of the hinged leg 2 (FIG. 4).

Also, when the board is closed (FIG. 3), the hinged leg 2 is kept more firmly in the folded position by the spring R. The board therefore remains more firmly closed when put away and/or when being moved about in the closed position, when the board is rolled sideways on the wheels F located at the bottom of the non-hinged leg 1 (FIG. 4).

The invention claimed is:

1. A collapsible ironing board comprising a board arranged on two legs forming an X configuration, the center of the X constituting the central axis (C) about which the two legs can pivot; at least one of the two legs being an articulated leg that is hinged and consists of two continuous segments pivoting about a hinge axis (D), and wherein the ironing board includes a return means (R) located in the environment of the hinge axis (D).

2. The ironing board as claimed in claim 1, wherein said return means (R) comprise a first end and a second end connected to the first segment and to the second segment, respectively, of the hinged leg.

3. The ironing board as claimed in claim 1, wherein the return means comprise a spring.

4. The ironing board as claimed in claim 1, wherein the return means (R) are mounted at least partly inside the hinged leg.

5. The ironing board as claimed in claim 1, wherein the return means (R) are mounted completely inside the hinged leg.

6. The board as claimed in claim 1, wherein the return means (R) are so arranged as to exert a return force in a direction parallel to the direction of the hinged leg when in the open position.

7. The board as claimed in claim 1, wherein the distance between the hinge axis (D) and the first point of connection of the return means to the first segment of the hinged leg is different than the distance between the hinge axis (D) and the second point of connection of the return means to the second segment of the hinged leg.

8. The board as claimed in claim 1, wherein the return means (R) consist of a spring and a rigid rod, one of the ends of which is connected to one of the ends of the spring, the other end of the rigid rod being connected to and able to pivot on one of the segments of the hinged leg.

9. A collapsible ironing board comprising a board arranged on two legs forming an X configuration, the center of the X constituting the central axis (C) about which the two legs can pivot; at least one of the two legs being an articulated leg that is hinged and consists of two continuous segments pivoting about a hinge axis (D), and wherein the ironing board includes a spring means (R) located adjacent to the hinge axis (D).

10. The ironing board as claimed in claim 9, wherein said spring means (R) comprise a first end and a second end connected to the first segment and to the second segment, respectively, of the hinged leg.

11. The ironing board as claimed in claim 9, wherein the spring means comprise a spring.

12. The ironing board as claimed in claim 9, wherein the spring means (R) are mounted at least partly inside the hinged leg.

13. The ironing board as claimed in claim 9, wherein the spring means (R) are mounted completely inside the hinged leg.

14. The board as claimed in claim 9, wherein the spring means (R) are so arranged as to exert a spring force in a direction parallel to the direction of the hinged leg when in the open position.

15. The board as claimed in claim 9, wherein the distance between the hinge axis (D) and the first point of connection of the spring means to the first segment of the hinged leg is different than the distance between the hinge axis (D) and the second point of connection of the spring means to the second segment of the hinged leg.

16. The board as claimed in claim 9, wherein the spring means (R) consist of a spring and a rigid rod, one of the ends of which is connected to one of the ends of the spring, the other end of the rigid rod being connected to and able to pivot on one of the segments of the hinged leg.

* * * * *